US011712782B2

(12) United States Patent
Mestanek et al.

(10) Patent No.: US 11,712,782 B2
(45) Date of Patent: Aug. 1, 2023

(54) ABRASIVE HEAD WITH CLEAN GAS INFEED

(71) Applicants: PTV, spol. s r. o., Hostivice (CZ); Institute of Geonics of the CAS, Poruba (CZ)

(72) Inventors: Jiri Mestanek, Repy (CZ); Zdenek Riha, Kohoutovice (CZ)

( * ) Notice: Subject to any disclaimer, the term of this patent is extended or adjusted under 35 U.S.C. 154(b) by 958 days.

(21) Appl. No.: 16/416,295

(22) Filed: May 20, 2019

(65) Prior Publication Data

US 2019/0366509 A1 Dec. 5, 2019

(30) Foreign Application Priority Data

May 22, 2018 (CZ) ..... CZ2018-235

(51) Int. Cl.

| | |
|---|---|
| ***B24C 5/02*** | (2006.01) |
| ***B24C 5/04*** | (2006.01) |
| ***B24C 7/00*** | (2006.01) |

(52) U.S. Cl.

CPC ..... *B24C 7/003* (2013.01); *B24C 5/02* (2013.01); *B24C 5/04* (2013.01); *B24C 7/0007* (2013.01); *B24C 7/0038* (2013.01); *B24C 7/0046* (2013.01); *B24C 7/0076* (2013.01)

(58) Field of Classification Search

CPC ..... B24C 5/02; B24C 5/04; B24C 7/0007; B24C 7/003; B24C 7/0038; B24C 7/0046; B24C 7/0069; B24C 7/0076; B24C 7/0084

USPC ..... 451/38, 39, 40, 102

See application file for complete search history.

(56) References Cited

U.S. PATENT DOCUMENTS

| | | | | |
|---|---|---|---|---|
| 2,107,084 | A * | 2/1938 | Pletcher | B24C 5/02 417/187 |
| 4,555,872 | A * | 12/1985 | Yie | B24C 11/005 451/40 |
| 4,995,202 | A | 2/1991 | Gardner et al. | |
| 8,210,908 | B2 * | 7/2012 | Hashish | B24C 7/0076 451/38 |
| 8,353,741 | B2 * | 1/2013 | Fowler, III | B24C 1/086 451/39 |
| 10,058,978 | B2 * | 8/2018 | Sato | B24C 5/04 |
| 2005/0017091 | A1 * | 1/2005 | Olsen | B24C 5/02 239/416.1 |
| 2017/0326706 | A1 * | 11/2017 | Sato | B24C 5/04 |
| 2019/0366508 | A1 * | 12/2019 | Mestanek | B24C 7/0084 |

FOREIGN PATENT DOCUMENTS

| | | |
|---|---|---|
| EP | 3094448 | 12/2017 |
| GB | 774624 | 5/1957 |
| JP | S6228173 | 2/1987 |

OTHER PUBLICATIONS

Search Report, Industrial Property Office of the Czech Republic, dated Jan. 30, 2019.

* cited by examiner

*Primary Examiner* — Eileen P Morgan

(74) *Attorney, Agent, or Firm* — Cionca IP Law P.C.; Marin Cionca

(57) ABSTRACT

An abrasive head with clean gas infeed for cleaning/removing material surfaces and splitting/cutting materials by a liquid beam enriched with solid abrasive particles to extend the tool lifetime by eliminating damage to the liquid jet's aperture by the abrasive, avoid degrading the abrasive inside the tool and increase the cutting power and flow efficiency.

3 Claims, 3 Drawing Sheets

Figure 3:
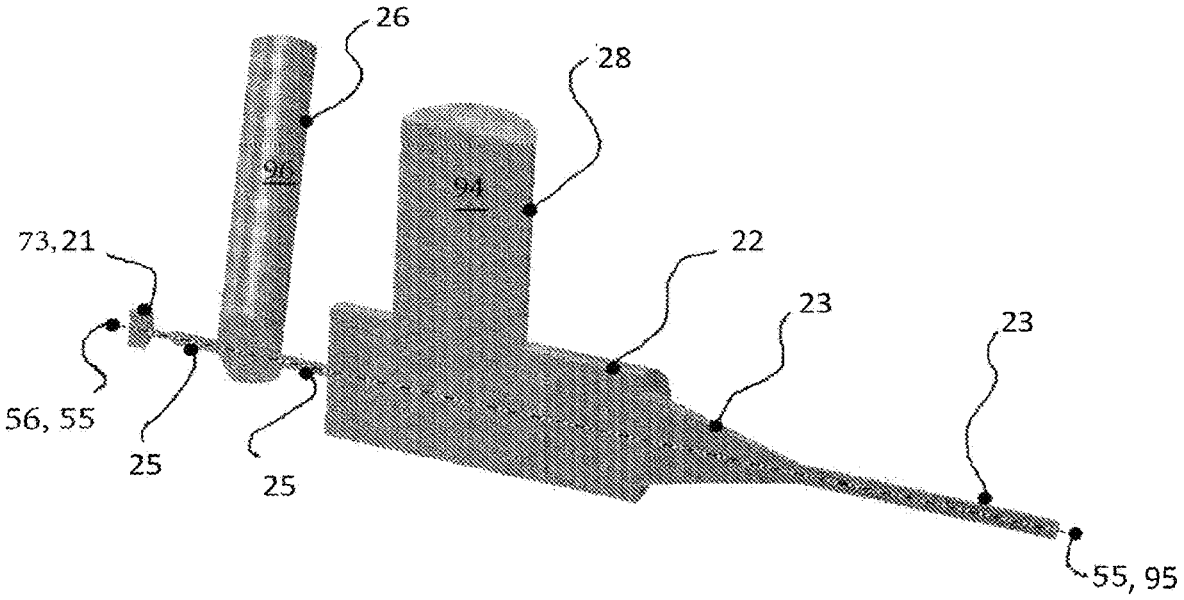

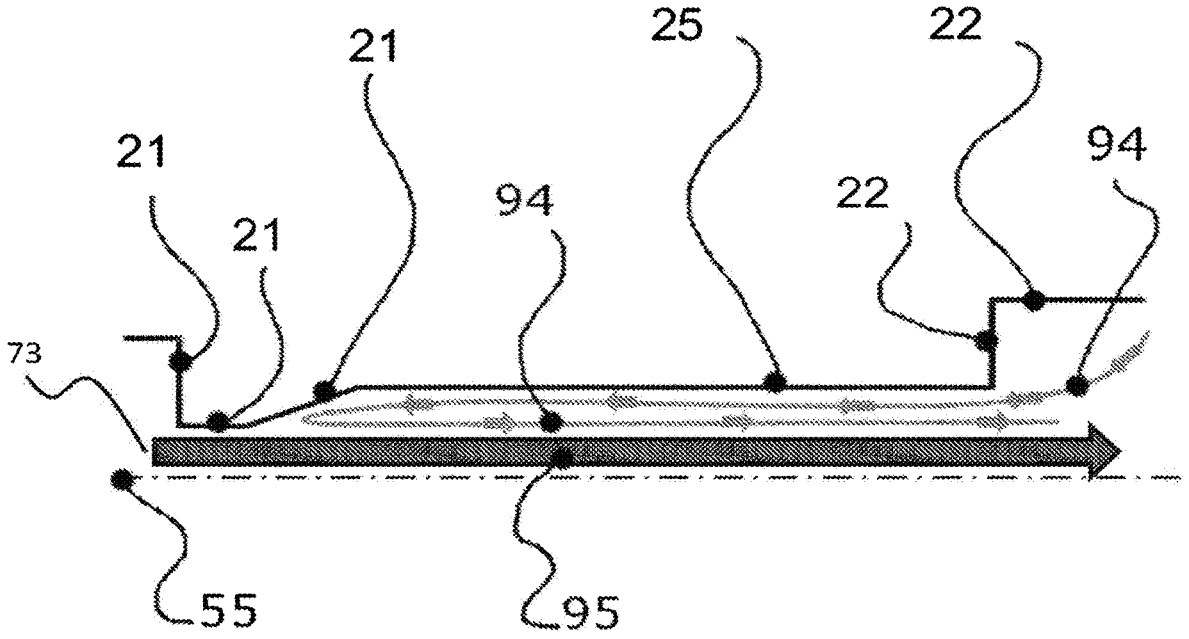
Fig. 1 - Prior Art
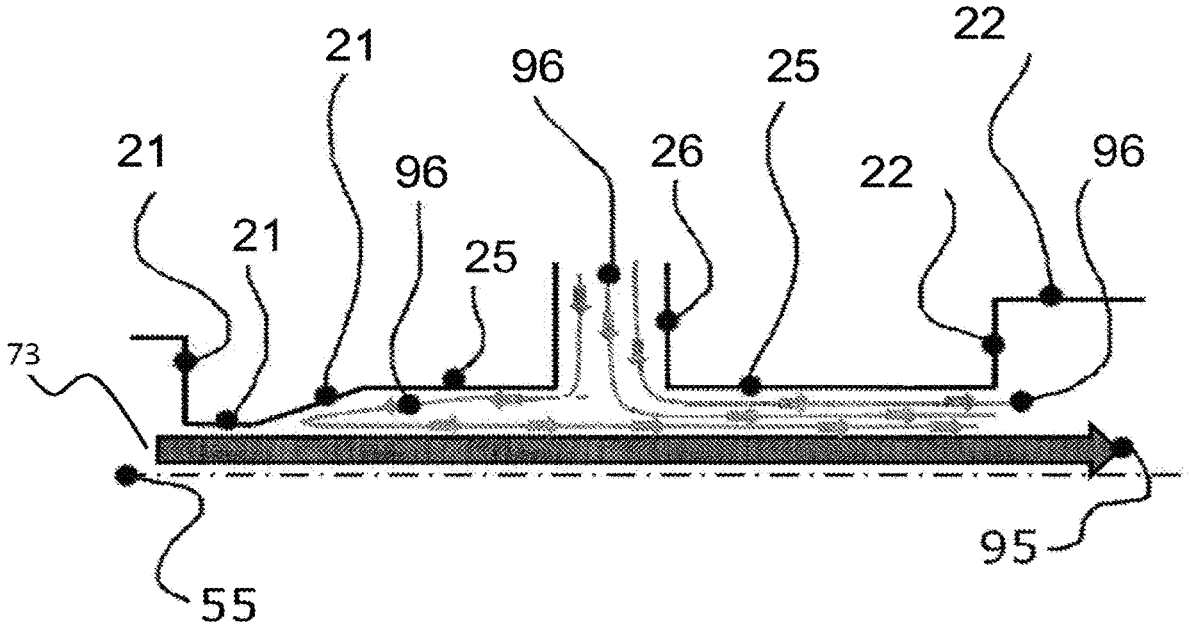
Fig 2 - Prior Art

ABRASIVE HEAD WITH CLEAN GAS INFEED

CROSS-REFERENCE TO RELATED APPLICATIONS

The present application claims priority from Czech patent Application No. PV 2018-235 filed on May 22, 2018, the entire contents of which are incorporated herein by reference.

FIELD OF TECHNOLOGY

The technical solution falls within the hydraulics area. The patent subject-matter is a tool to clean/remove material surfaces and split/clean materials with a liquid beam enriched with solid abrasive particles.

STATE OF THE ART

At present, an abrasive head is used as a tool with predominantly automatic gas and abrasive intake to split and cut various materials. The tool consists of three main components: liquid jet, mixing chamber and abrasive jet. The above-mentioned components are positioned in line along the tool axis in a way that the high-speed liquid beam formed by a liquid jet passing all along the tool axis. Water may be used as the liquid here. Air may be used as the gas. The liquid jet is designed to convert pressure energy into kinetic energy, thus creating a high-speed liquid beam. The thin liquid beam passes through the center of the tool or other abrasive head's main parts. The beam movement in the mixing chamber center may result in automatic gas and abrasive intake into the mixing chamber. The gas and abrasive particles are accelerated here by the high-speed liquid beam motion. The created mixture of liquid, gas and abrasive particles flows on to pass through the abrasive jet center. Further acceleration of the gas and abrasive particles is made by the action of the high-speed liquid beam flowing in housing interior of the abrasive jet, which is largely formed by an input cone linked with the upstream mixing chamber shape and a long cylindrical opening.

Document US 2017326706 may appear to be the closest technological state. It describes the jet head dealing with the gas infeeds to stabilize the water beam. The gas infeeds are implemented both upstream and downstream the mixing chamber. The gas infeeds are implemented by several components arranged and inserted in the jet head, while the gas is supplied upstream, i.e. under an angle of more than 90° to the common axis into the point with the highest liquid beam velocity, directly under the liquid jet where huge energy losses of the liquid beam occur. The liquid beam loses its velocity and the vortex flow may even unbalance the liquid beam. Thus, the solution according to document US 2017326706 is nearly unusable in practice. Further documents representing general technological state include for example document EP 3094448 A, U.S. Pat. No. 4,995,202, where liquid is supplied in the jet head in a fully unbalanced manner from the side, thus losing huge amount of energy and in addition, the gas is supplied upstream the liquid flow, thus dramatically reducing the liquid beam velocity leading to vortex flow. Documents JP 56228173 and GB 774624 represent general technological state.

The disadvantage of current solutions such as patents EP2853349A1 EP0873220B1 as well as US2016/0129551A1 or PV 2014-754 is that the high-speed liquid beam after the liquid jet creates such flow field of the entire mixture that allows the abrasive particles to flow up to the liquid jet itself. Intensive gas backflow is formed around the high-speed beam, carrying the abrasive particles to the liquid jet body. It's been proved that the water jet gets worn out by the abrasive particles as they flow in space directly after the water jet. The described fact shown on FIG. 1 results in significant reduction of the liquid jet's as well as the entire described tool's lifetime. Another resulting disadvantage is that guaranteeing sufficient tool lifetime requires that the liquid jet be made of very durable and costly material such as diamond.

DESCRIPTION OF THE INVENTION

A new abrasive head with clean gas infeed to split/cut materials by a liquid beam enriched with solid abrasive particles was developed. This head significantly extends the tool lifetime by eliminating damage to the liquid jet's aperture by abrasive as well as eliminating degradation of abrasive inside the tool.

The abrasive head fully prevents the gas and abrasive mixture backflow upstream towards the water jet, making the abrasive particles move downstream outside the tool, thus eliminating damage to the water jest and degradation of the abrasive itself.

The backflow avoidance is designed in a manner that the abrasive head contains a clean gas infeed in the liquid beam infeed channel. The clean gas infeed makes the gas intake into the abrasive head, thus eliminating unwanted air recirculation along with the particles of the abrasive itself that harm the tool's internal walls and mainly the liquid jet's walls. The recirculation is shown on FIGS. 1 and 2, with FIG. 1 describing gas and abrasive upstream recirculation up to the liquid jet in case when no clean gas infeed is installed, while FIG. 2 shows clean gas flow through the channel downstream of the liquid beam flow which eliminates backward recirculation of gas and abrasive by filling the entire channel. Thus, clean gas supply into the infeed channels is made separately before the abrasive infeed.

From the pressurized water infeed up to the abrasive jet, i.e. downstream, the tool consists of the liquid jet connected to the infeed channel equipped with the clean gas intake. The liquid jet leads into the mixing chamber connected to the abrasive jet. The clean gas infeed has the benefit of being inclined to the common axis by 10 to 90°. At least one gas and abrasive mixture infeed leads into the mixing chamber, the gas and abrasive mixture has the advantage of being fed into the mixing chamber through several symmetrically positioned infeeds. The gas and abrasive mixture infeed has the benefit of being inclined relative to the common axis by 10 to 90°. The infeeds of gas and abrasive mixture have the benefit of being connected to the gas and abrasive mixture distributor.

The liquid jet, infeed channel, mixing chamber and abrasive jet are positioned in the tool's axis downstream of the pressurized water infeed. The infeed channel's inner cross-section is smaller than the abrasive jet cylindrical part's inner cross-section, which guarantees automatic gas and abrasive mixture intake into the abrasive jet.

The clean gas intake can extend the lifetime of an existing tool. The clean gas infeed can be implemented in an existing tool in a fairly easy way such as with electro-erosive machining.

Thus, in the case of a new tool, damage to the liquid jet by abrasive particles is fully avoided, still without any decrease in both the abrasive head's cutting power as well as energy.

Tool Design Implementation

The tool design should be selected with respect to the tool load level. Stressed tool components, bearing housings and jets may be made of hard metal or high-strength abrasive-resistant steel (such as 17-4PH, 17022, 1.4057 or 17346 steel etc.) and it's recommended to select high-strength materials such as diamond or sapphire for the liquid jets. For connections and unstressed tool parts, it's possible to select less resistant materials such as PVC.

It's useful when the tool is made of a bearing housing in which the liquid jet inner housing is inserted along with other tool components. The pressurized water connection is located on the top part of the supporting housing. The liquid jet body, the common channel housing, the inserted jet body and the mixing chamber housing are placed inside the inner body while the housings and other components may be connected using threaded joint, press connection or other permanent or demountable means. More housings and/or components can be made of a single piece. The abrasive jet housing is placed at the bottom of the supporting housing. As a benefit, the abrasive jet housing can be fixed in the supporting housing with a threaded joint or can be attached to the supporting housing via a collet with a nut. The mixing chamber can be a direct part of the bearing housing.

SUMMARY OF PRESENTED DRAWINGS

FIG. 1 (Prior Art). Technology status. A tool without separate clean gas infeed 96.

FIG. 2 (Prior Art). A tool with a separate clean air 96 infeed 26.

FIG. 3. An abrasive head according to example 1 with a single liquid jet clean gas infeed 26 in infeed channel 25.

Figure 4:
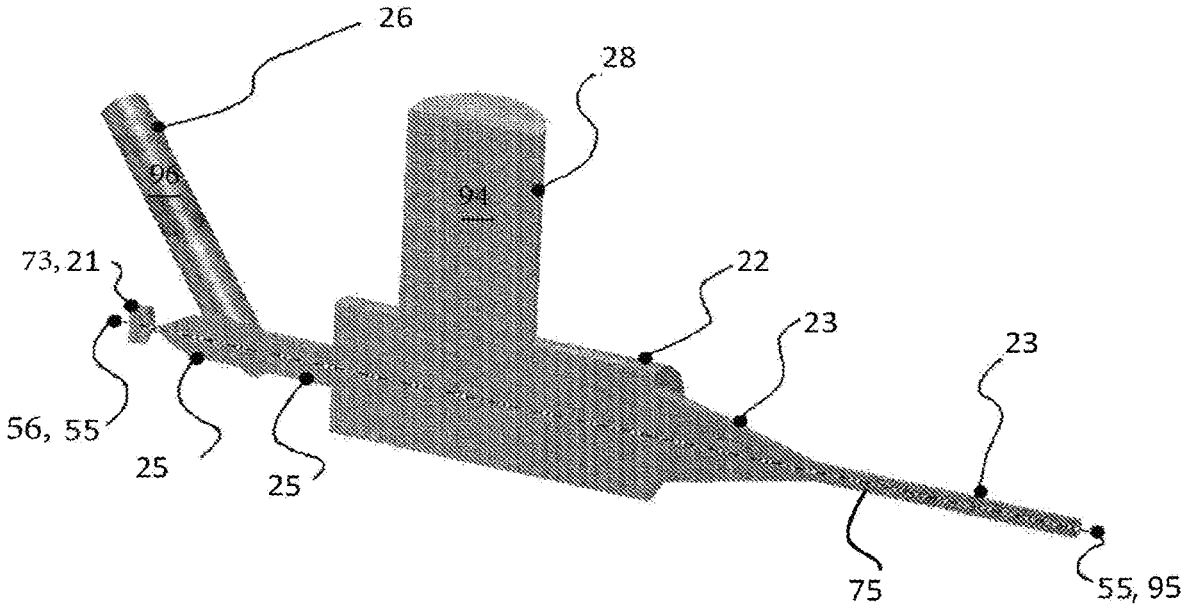

FIG. 4. An abrasive head according to example 2 with a single liquid jet and inclined clean gas infeed 26 into the infeed channel 25.

Figure 5:
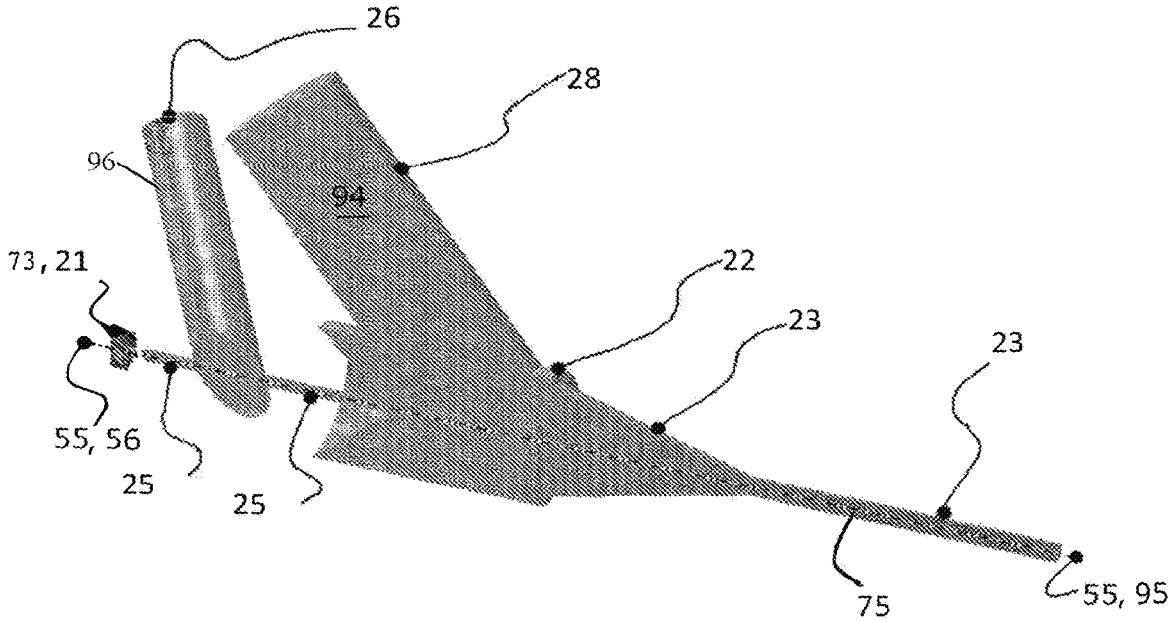

FIG. 5. An abrasive head according to example 3 with a single liquid jet, inclined clean gas 96 infeed 26 into the infeed channel 25 and inclined infeed 28 of the gas and abrasive mixture 94.

Figure 6:
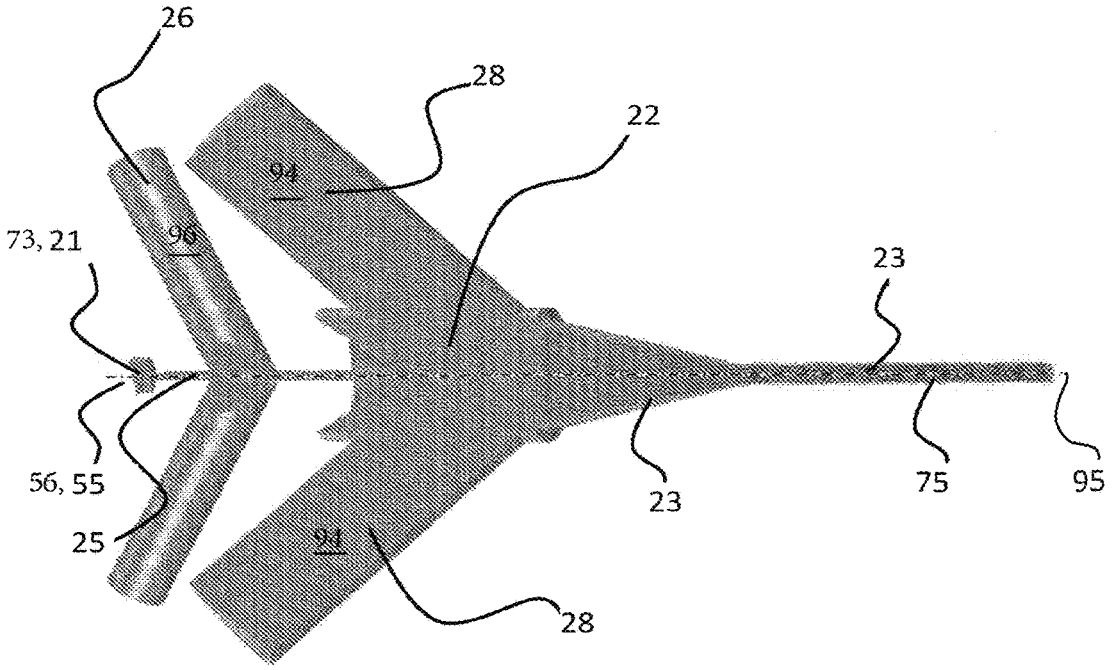

FIG. 6. An abrasive head according to example 4 with a single liquid jet, two inclined clean gas 96 infeeds 26 into the infeed channel 25 and two inclined infeeds 28 of the gas and abrasive mixture 94.

EXAMPLES OF INVENTION EXECUTION

Example 1

Abrasive Head with Clean Gas Infeed into the Common Channel.

FIG. 3 shows a tool design with clean gas intake 96 through the infeed 26 leading into the infeed channel 25 is positioned downstream of the water jet 21 located downstream of the pressurized liquid infeed 73. The water jet 21 is connected to the infeed channel 25 into which the clean gas 96 infeed 26 leads. The tool main components, i.e. water jet 21 (referred to herein as "water jet" or "liquid jet"), mixing chamber 22 and abrasive jet 23 are positioned in the tool axis 55, while the liquid jet 21 axis is identical with the axis of the infeed channel 25 and the tool axis 55. The infeed channel 25 leads into the mixing chamber 22 together with one infeed 28 of the gas and abrasive mixture 94. The inner cross-section of the infeed channel 25 is smaller than the abrasive jet 23 cylindrical part's 75 inner cross-section. This results in the gas and abrasive mixture 94 being suctioned into the mixing chamber 22 through the infeed 28 of the gas and abrasive mixture 94 automatically, just like the clean gas 96 is automatically suctioned through the clean gas 26 infeed 96. The gas and abrasive mixture 94 accelerated by the common high-speed liquid beam 95 enters the abrasive jet 23 connected to the mixing chamber 22. The abrasive jet 23 is positioned in the tool axis 55 at the tool's end. At this point, further acceleration of the described mixture occurs before impacting on the cut material.

The abrasive head bearing housing, where liquid jet 21, mixing chamber housing 22 and abrasive jet body 23 are placed, contains infeed channel 25 downstream of the water jet 21, clean gas 96 infeed 26 and the infeed 28 of the gas and abrasive mixture 94. It's made of 17-4PH steel. The mixing chamber housing 22 is made of hard metal. The abrasive jet's housing 23 is made of hard metal. Clean gas 96 infeed 26 made of 17022 steel is connected to the abrasive head's bearing housing. Gas and abrasive mixture 94 infeed 28 made of 17022 steel is connected to the abrasive head's bearing housing.

In case of a tool made according to example 1, there is no gas recirculation thanks to the presence of the clean gas 96 infeed 26 into the infeed channel 25. Thanks to the recirculation avoidance, the abrasive particles don't get near and don't harm the liquid jet 21 while avoiding their degradation here.

Example 2

An Abrasive Head with Inclined Clean Gas Infeed into the Infeed Channel.

FIG. 4 shows a tool design example with clean gas intake 96 through the infeed 26 leading into the common channel 25 under an angle of 55° to the tool axis 55 downstream after the water jet 21 installed after the pressurized liquid infeed 73. The water jet 21 is connected to the infeed channel 25 into which the clean gas 96 infeed 26 leads. The tool main components, i.e. water jet 21, mixing chamber 22 and abrasive jet 23 are positioned in the tool axis 55, while the liquid jet 21 axis 56 is identical with the axis of the infeed channel 25 and the tool axis 55. The infeed channel 25 leads into the mixing chamber 22 together with one infeed 28 of the gas and abrasive mixture 94. The inner cross-section of the infeed channel 25 is greater than the abrasive jet 23 cylindrical part's 75 inner cross-section. This results in the gas and abrasive mixture 94 being suctioned into the mixing chamber 22 through the infeed 28 of the gas and abrasive mixture 94 by overpressure, with the clean gas 96 being automatically suctioned through the clean gas 96 infeed 26. The gas and abrasive mixture 94 accelerated by the common high-speed liquid beam 95 enters the abrasive jet 23 connected to the mixing chamber 22. The abrasive jet 23 is positioned in the tool axis 55 at the tool's end. At this point, further acceleration of the described mixture occurs before impacting on the cut material.

The abrasive head bearing housing, where liquid jet body 21 and abrasive jet body 22 are placed, contains infeed channel 25 downstream the water jet 21, mixing chamber 22 and the infeed 28 of the gas and abrasive mixture 94. It's made of 1.4057 abrasion-resistant steel. The abrasive jet's housing 23 is made of hard metal. Clean gas 96 infeed 26 made of 17346 steel is connected to the abrasive head's bearing housing. The gas and abrasive mixture 94 infeed 28 made of 17346 steel is connected to the abrasive head's bearing housing.

In case of a tool made according to example 2, there is no gas recirculation thanks to the presence of the clean gas 96 infeed 26 into the infeed channel 25. Thanks to the recirculation avoidance, the abrasive particles don't get near and don't harm the liquid jet 21 while avoiding their degradation here.

Example 3

An Abrasive Head with Inclined Gas and Abrasive Mixture Infeed and Inclined Clean Gas Infeed.

FIG. 5 shows a tool design example with clean gas intake 96 through the infeed 26 leading into the infeed channel 25 downstream of the water jet 21 located downstream of the pressurized liquid infeed 73. The water jet 21 is connected to the infeed channel 25 into which the clean gas 96 infeed 26 leads, inclined to the tool axis 55 by 60° downstream of the water jet 21. The tool main components, i.e. water jet 21, mixing chamber 22 and abrasive jet 23 are positioned in the tool axis 55, while the liquid jet 21 axis 56 is identical with the axis of the infeed channel 25 and the tool axis 55. The infeed channel 25 leads into the mixing chamber 22 together with one infeed 28 of the gas and abrasive mixture 94 inclined to the tool axis 55 by 50° downstream. The inner cross-section of the infeed channel 25 is smaller than the abrasive jet 23 cylindrical part's 75 inner cross-section. This results in the gas and abrasive mixture 94 being suctioned into the shaped mixing chamber 22 through the infeed 28 of the gas and abrasive mixture 94 automatically, just like the clean gas 96 is automatically suctioned through the clean gas 26 infeed 96. The gas and abrasive mixture 94 accelerated by the common high-speed liquid beam 95 enters the abrasive jet 23 connected to the mixing chamber 22. The abrasive jet 23 is positioned in the tool axis 55 at the tool's end. At this point, further acceleration of the described mixture occurs before impacting on the cut material.

The abrasive head bearing housing, where liquid jet body 21, mixing chamber housing 22 and abrasive jet body 23 are placed, contains infeed channel 25 downstream of the water jet 21, clean gas 96 infeed 26 and the infeed 28 of the gas and abrasive mixture 94. It's made of 17022 steel. The mixing chamber housing 22 is made of hard metal. The abrasive jet's housing 23 is made of hard metal. The liquid jet 21 is made of sapphire and the infeed channels 25 are made of PVC. Clean gas 96 infeed 26 made of 17022 steel is connected to the abrasive head's bearing housing. Gas and abrasive mixture 94 infeed 28 made of 17-4PH steel is connected to the abrasive head's bearing housing.

In case of a tool made according to example 3, there is no gas recirculation thanks to the presence of the clean gas 96 infeed 26 into the infeed channel 25. Thanks to the recirculation avoidance, the abrasive particles don't get near and don't harm the liquid jet 21 while avoiding their degradation here.

Example 4

An Abrasive Head with Two Inclined Gas and Abrasive Mixture Infeeds and Inclined Clean Gas Infeeds.

FIG. 6 shows a tool design example with clean gas intake 96 through the infeed 26 leading into the infeed channel 25 downstream of the water jet 21 located downstream of the pressurized liquid infeed 73. The water jet 21 is connected to the infeed channel 25 into which two clean gas 96 infeeds 26 leads, inclined to the tool axis 55 by 60° downstream. The tool main components, i.e. water jet 21, mixing chamber 22 and abrasive jet 23 are positioned in the tool axis 55, while the liquid jet 21 axis 56 is identical with the axis of the infeed channel 25 and the tool axis 55. The infeed channel 25 leads into the mixing chamber 22 together with two infeeds 28 of the gas and abrasive mixture 94 inclined to the tool axis 55 by 55° downstream. The gas and abrasive 94 mixture infeeds 28 are connected to the distributor of the gas and abrasive mixture 94. The inner cross-section of the infeed channel 25 is smaller than the abrasive jet 23 cylindrical part's 75 inner cross-section. This results in the gas and abrasive mixture 94 being suctioned into the shaped mixing chamber 22 through the infeeds 28 of the gas and abrasive mixture 94 automatically, just like the clean gas 96 is automatically suctioned through the clean gas 26 infeed 96. The gas and abrasive mixture 94 accelerated by the common high-speed liquid beam 95 enters the abrasive jet 23 connected to the mixing chamber 22. The abrasive jet 23 is positioned in the tool axis 55 at the tool's end. At this point, further acceleration of the described mixture occurs before impacting on the cut material.

The abrasive head bearing housing, where liquid jet body 21, mixing chamber housing 22 and abrasive jet body 23 are placed, contains infeed channel 25 downstream of the water jet 21, clean gas 96 infeed 26 and the infeed 28 of the gas and abrasive mixture 94. It's made of 17022 steel. The mixing chamber housing 22 is made of hard metal. The abrasive jet's housing 23 is made of hard metal. The liquid jet 21 is made of sapphire and the infeed channels 25 are made of PVC. Clean gas 96 infeed 26 made of 17022 steel is connected to the abrasive head's bearing housing. Gas and abrasive mixture 94 infeed 28 made of 17-4PH steel is connected to the abrasive head's bearing housing.

In case of a tool made according to example 4, there is no gas recirculation thanks to the presence of the clean gas 96 infeed 26 into the infeed channel 25. Thanks to the recirculation avoidance, the abrasive particles don't get near and don't harm the liquid jet 21 while avoiding their degradation here.

LIST REFERENCE MARKS

21—liquid jet or water jet
22—mixing chamber
23—abrasive jet
25—infeed channel
26—clean gas infeeds 96
28—infeeds of gas and abrasive mixture 94
55—tool axis
73—pressurized liquid infeed
75—abrasive jet cylindrical section 23
94—gas and abrasive mixture
95—liquid beam
96—clean gas

APPLICABILITY IN INDUSTRY

Cleaning materials, removing material surfaces, splitting or cutting materials by liquid beam enriched with abrasive solid particles.

The invention claimed is:

1. An abrasive blasting head for at least one of splitting and cutting materials, the abrasive blasting head comprising: a liquid jet source (21) for delivering a liquid jet into a downstream infeed channel (25) of the blasting head, a gas infeed (26) for feeding clean gas into the infeed channel (25), the infeed channel connected to a mixing chamber (22) equipped with at least one mixture infeed (28) fora gas and abrasive mixture (94), the mixing chamber (22) connected to an abrasive jet nozzle (23) characterized by the fact that the liquid jet source (21) leads into the infeed channel (25), which leads into the mixing chamber (22), which leads into the abrasive jet nozzle (23), wherein a longitudinal axis of the liquid jet source (21) and a longitudinal axis of the abrasive jet nozzle (23) are lying along a common tool axis, while, the infeed channel (25) comprises only one gas infeed (26) for clean gas (96), the gas infeed (26) for clean gas being inclined at an angle of 10° to 60° leading downstream relative to the tool axis and wherein an inner cross-section area of the infeed channel (25) is smaller than an inner cross-section area of the abrasive jet nozzle (23), which, in use, results in and guarantees automatic intake of the gas and abrasive mixture (94) into the abrasive jet nozzle, within which the gas and abrasive mixture (94) is accelerated.

2. The abrasive blasting head according to claim 1 characterized by the fact that the mixing chamber (22) contains at least two infeeds for the gas and abrasive mixture (94).

3. The abrasive blasting head according to claim 1 characterized by the fact that the mixture infeed (28) for the gas and abrasive mixture (94) is inclined to the common axis at an angle of 10° to 90°.

* * * * *